US006163590A

United States Patent [19]

Wilkins

[11] Patent Number: 6,163,590

[45] Date of Patent: Dec. 19, 2000

[54] HIGH RESOLUTION X-RAY IMAGING OF VERY SMALL OBJECTS

[75] Inventor: Stephen William Wilkins, Blackburn, Australia

[73] Assignee: X-Ray Technologies PTY Ltd., Melbourne, Australia

[21] Appl. No.: 09/180,878

[22] PCT Filed: Apr. 8, 1998

[86] PCT No.: PCT/AU98/00237

§ 371 Date: Apr. 8, 1999

§ 102(e) Date: Apr. 8, 1999

[87] PCT Pub. No.: WO98/45853

PCT Pub. Date: Oct. 15, 1998

[30] Foreign Application Priority Data

Apr. 8, 1997 [AU] Australia ..... PO6041
Jun. 20, 1997 [AU] Australia ..... PO7453

[51] Int. Cl.[7] ..... G21K 7/00

[52] U.S. Cl. ..... 378/43; 378/62; 378/208

[58] Field of Search ..... 378/43, 62, 208

[56] References Cited

U.S. PATENT DOCUMENTS

| | | | |
|---|---|---|---|
| 5,044,001 | 8/1991 | Wang | 378/43 |
| 5,389,787 | 2/1995 | Todokoro et al. | 250/310 |
| 5,426,686 | 6/1995 | Rentzepis et al. | 378/34 |
| 5,512,746 | 4/1996 | Saito | 250/310 |
| 5,528,646 | 6/1996 | Iketaki et al. | 378/43 |
| 5,550,378 | 8/1996 | Skillicorn et al. | 250/367 |
| 5,563,415 | 10/1996 | Crewe | 250/396 ML |
| 5,629,969 | 5/1997 | Koshishiba | 378/138 |
| 5,832,052 | 11/1998 | Hirose et al. | 378/43 |

FOREIGN PATENT DOCUMENTS 0 751 533 A1 2/1997 European Pat. Off. ..... G21K 7/00

OTHER PUBLICATIONS

Yada, et al.; "Target Materials Suitable for Projection X–Ray Microscope Observation of Biological Samples"; Research Institute for Scientific Measurements, Tohoku University, Japan; J. Electron Micrsoc., vol. 38, No. 5, 321–331 (1989).

Yada, et al.; "Biological Applications of Projection X–Ray Miscroscopy"; Tokyo Metropolitan Institute of Medical Science; Tokyo, Japan; pp. 171–180.

Takahashi, et al.; "Three–Dimensional Visualization of Golgi–Stained Neurons by a Projection X–Ray Microscope Converted from a Scanning Electron Microscope"; Tohoku Journal of Experimental Medicine; (1983) 141, 249–256.

Yada, et al.; "Transmission Type X–Ray Shadow Microscope Converted from Scanning Electon Microscope"; Tohoku University; vol. 29 (1980) (1 sheet).

Horn, et al.; "How to Obtain and Use X–Ray Projection Microscopy in th caSEM"; Scanning; vol. 1,2 (1978) (9 sheets).

B. D. Cullity, Elements of X–Ray Diffraction, 2nd Ed. (Reading, MA: Addison–Wesley, 1978).

*Primary Examiner*—David V. Bruce
*Assistant Examiner*—Allen C. Ho
*Attorney, Agent, or Firm*—Fulwider Patton Lee & Utecht, LLP

[57] ABSTRACT

A sample cell for use in x-ray imaging, including structure defining a chamber for a sample and, mounted to the structure, a body of a substance excitable by an appropriate incident beam to generate x-ray radiation, the cell being arranged so that, in use, at least a portion of the x-ray radiation traverses the chamber to irradiate the sample therein and thereafter exits the structure for detection.

41 Claims, 8 Drawing Sheets

HIGH RESOLUTION X-RAY IMAGING OF VERY SMALL OBJECTS

FIELD OF THE INVENTION

This invention relates generally to the high resolution imaging of features of very small objects utilising penetrating radiation such as x-rays. The invention is especially suitable for carrying out x-ray phase contrast microscopic imaging, and may be usefully applied to the ultra high spatial resolution imaging of microscopic objects and features, including small biological systems such as viruses and cells and possibly including large biological molecules.

BACKGROUND ART

A known approach to microscopy utilising x-rays is projection x-ray microscopy, in which a focussed electron beam excites and thereby generates a spot x-ray source in a foil or other target. The object is placed in the divergent beam between the target and a photographic or other detection plate. There have more recently been a number of proposals for using the electron beam of an electron microscope to excite a point source for x-ray microscopy. Integration of an x-ray tomography device directly into an electron microscope was proposed by Sasov, at J. Microscopy 147, 169, 179 (1987). Prototype x-ray tomography attachments for scanning electron microscopes using charge coupled device (CCD) detectors have been proposed in Cazaux et al, J. Microsc. Electron. 14, 263 (1989), Cazaux et al, J. Phys. (Paris) IV C7, 2099 (1993) and Cheng et al X-ray Microscop) III, ed. A. Michette et al (Springer Berlin, 1992), page 184. Ferreira de Paiva et al (Rev. Sci. Instrum. 67(6), 2251 (June 1996)) have developed and studied the performance of a microtomography system based on the Cazaux and Cheng proposals. Their arrangement was an adaptation of a commercially available electron microprobe and was able to produce images at around 10 $\mu$m resolution without requiring major alterations to the electron optical column. The authors concluded that a 1 $\mu$m resolution in tomography was feasible for their device. All system components and methods of interpretation of image intensity data in these works were based on the mechanism of absorption contrast.

A review article by W. Nixon concerning x-ray microscopy may be found in "X-rays: The First Hundred Years", ed. A Michette & S. Pfauntsch, (Wiley, 1996, ISBN 0.471–96502-2), at ps 43–60.

The present applicant's international patent publication WO 95/05725 disclosed various configurations and conditions suitable for differential phase-contrast imaging using hard x-rays. Other disclosures are to be found in Soviet patent 1402871 and in U.S. Pat. No. 5,319,694. Practical methods for carrying out hard x-ray phase contrast imaging arc disclosed in the present applicant's co-pending international patent publication WO 96/31098 (PCT/AU96/00178). These methods preferably involve the use of microfocus x-ray sources, which could be polychromatic, and the use of appropriate distances between object and source and object and image plane. Various mathematical and numerical methods for extracting the phase change of the x-ray wavefield at the exit plane from the object are disclosed in that application and also in Wilkins et al "Phase Contrast Imaging Using Polychromatic Hard X-rays" Nature (London) 384, 335 (1996) and our co-pending international patent application PCT/AU97/00882. The examples given in these references primarily related to macroscopic objects and features, and to self contained conventional laboratory type x-ray sources well separated in space from the sample.

It is an object of the present invention, at least in a preferred application, to facilitate x-ray phase contrast imaging of microscopic objects and features.

DISCLOSURE OF THE INVENTION

The invention entails a realisation that the objective just mentioned can be met by a novel approach in the adaptation of electron microscopes to x-ray imaging or by the use of intense laser sources or x-ray synchrotron sources to produce a microfocus x-ray source.

In a first aspect of the invention, there is provided a sample cell for use in x-ray imaging, including structure defining a chamber for a sample, and, mounted to the structure, a body of a substance excitable by an appropriate incident beam to generate x-ray radiation, the cell being arranged so that, in use, at least a portion of the x-ray radiation traverses the chamber to irradiate the sample therein and thereafter exits the structure for detection.

In one embodiment, the cell is an integral self-contained unit adapted and dimensioned to be inserted in complementary holder means, e.g. the sample stage, of a scanning electron microscope or microprobe at a position where the electron beam of the microscope or microprobe is focussed on the body of excitable substance, and thereby provides the incident beam for exciting the substance to generate x-ray radiation.

In another embodiment, the substance is excitable by an incident focussed beam of electromagnetic radiation, e.g. a laser beam or synchrotron radiation beam, to generate x-ray radiation.

The cell is preferably an array of layers, of dimensions parallel to the plane of the layers in the range a micron or so to a few e.g. 10 millimeters. The cell is advantageously adapted for use in phase contrast imaging in that said layers through which the excited x-ray radiation passes are highly homogeneous and have very smooth surfaces for preserving high spatial coherence of the incident beam in the radiation that irradiates the sample, and thereby optimising useful contrast in the image. This is especially desirable for the exit surface from the layer of said excitable substance, and for subsequent layers in the sample cell.

The excitable substance is preferably a layer of the substance applied to the structure defining the cell but may also be free standing. This structure preferably includes a substrate and/or spacer layer, transparent generally to x-rays or to a selected x-ray energy band(s), separating the layer of excitable substance from the sample. Although largely transparent to the radiation energy band(s) of interest, the substrate and/or spatial layer may also be chosen such as to be strongly absorbing for energies outside this band(s) in order to enhance the chromatic coherence of the x-ray beam contributing to the image.

The said cell may be open, or may be arranged to be hermetically sealed, eg. to permit evacuation of the electron-microscope chamber after placement of the sample in the chamber. The chamber or cell may be adapted to be enclosed and if so the structure includes an x-ray transparent window by which the said x-ray radiation exits the structure for detection.

The layer of excitable substance is preferably of a thickness in the range 10 to 1000 nm, and the separation of this layer from the sample may be in the range 1 to 1000 $\mu$m.

In this first aspect, the invention extends to an x-ray microscope or microprobe, eg. a scanning x-ray microscope or microprobe, having means to generate a focussed electron beam, and a sample cell, as described above in any one or more of the variations described, retained in holder means at a position where said electron beam is focussed on said body of excitable substance and thereby provides said incident beam for exciting said substance to generate x-ray radiation. Preferably, for very high resolution imaging, the means to generate a focussed electron beam includes a field emission tip electron source.

In a second aspect, the invention provides a method of deriving a magnified x-ray image of one or more internal boundaries or other features of a sample, comprising:

disposing the sample in a sample cell according to the first aspect of the invention and fitting the cell into holder means of an electron microscope or microprobe at a position where the electron beam of the microscope or microprobe is focussed on said body of excitable substance and thereby provides said incident beam for exciting said substance to generate x-ray radiation;

irradiating the excitable substance with an electron beam to cause the substance to generate x-ray radiation, at least a portion of which traverses the chamber to irradiate the sample, including the one or more internal boundaries or other features, and thereafter exits the cell structure; and detecting and recording at least a portion of said radiation after it has irradiated the sample, to provide an image of the one or more internal boundaries or other features of the sample.

The x-ray imaging may be absorption-contrast or phase-contrast imaging or both. The invention is especially suited to performance of phase contrast imaging. The image(s)) may be energy filtered by the detector system or other means, or may be simultaneously collected as a set of images corresponding to a series of x-ray energy bands.

The x-ray radiation generated by the excitable substance is preferably in the medium to hard x-ray range, ie. in the range 1 keV to 1 MeV, and may be substantially monochromatic, or polychromatic. In the former case, the method may further include enhancing the degree of monochromaticity. In the practice of the method or use of the apparatus, the sample to image plane distance is preferably of the order of 10 to 200 mm.

In a still further aspect, the invention provides an x-ray microscopic imaging configuration comprising means to support a sample, a body of a substance excitable by an appropriate incident beam to generate x-ray radiation, said body being retained on a substrate disposed in use between said body and said sample and thereby serving as a spacer; and means to adjust the relative position of said sample and said body.

BRIEF DESCRIPTION OF THE DRAWINGS

The invention will now be further described, by way of example only, with reference to the accompanying drawings, in which.

PREFERRED EMBODIMENTS

Figure 1:
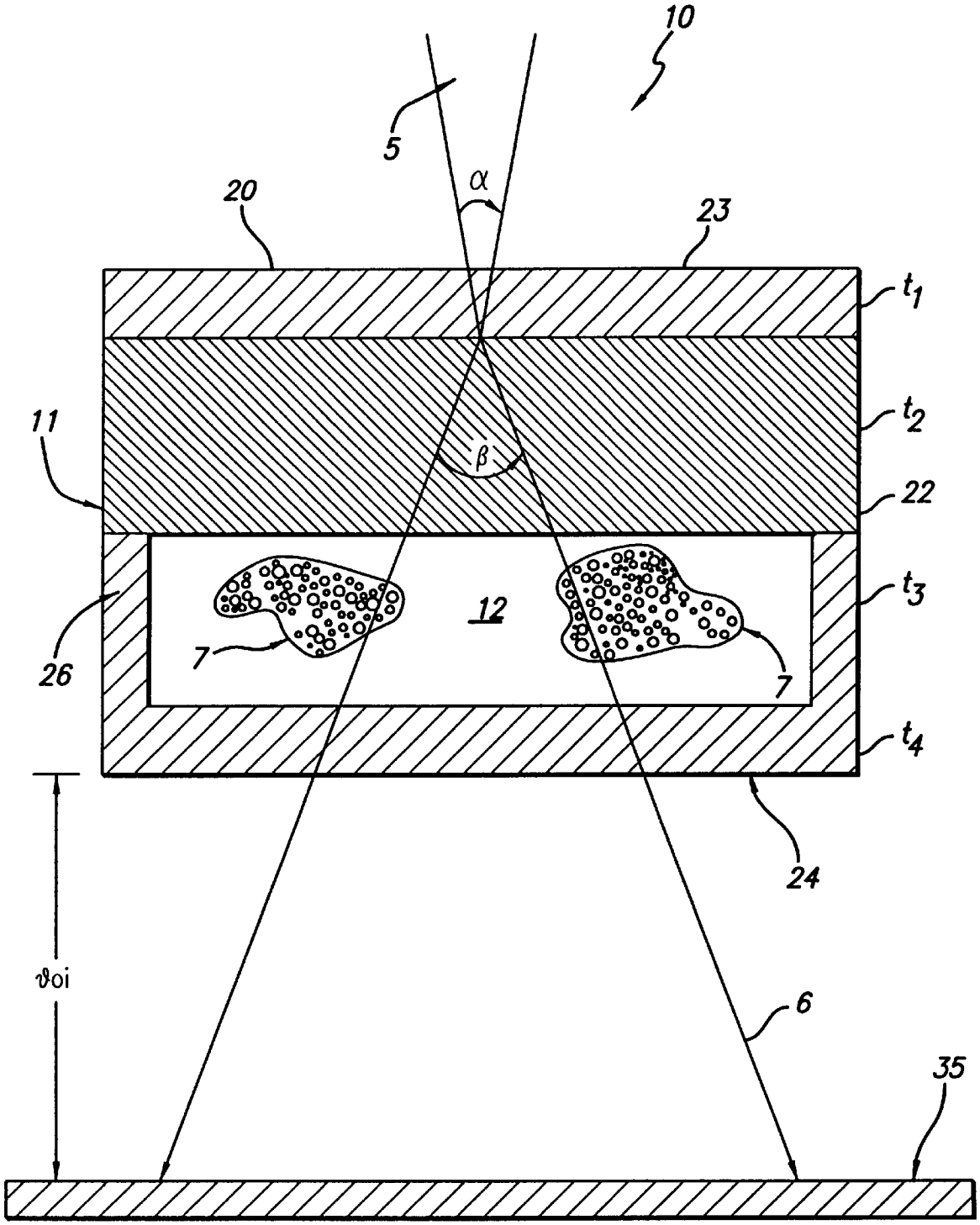
FIG. 1 is a cross sectional view of a sample cell according to an embodiment of a first aspect of the invention, for carrying out high resolution hard x-ray microscopy in accordance with an embodiment of the second aspect of the invention.

The sample cell 10 illustrated in FIG. 1 is an integral self-contained unit of generally three dimensional rectangular configuration. The cell includes structure 11 defining an enclosed sample chamber 12, and, mounted by being applied to structure 11, a body or target layer 20 of a substance excitable by an appropriate incident beam 5 to generate x-ray radiation 6. Cell 10 is arranged so that at least a portion of the radiation 6 traverses chamber 12 and thereby irradiates sample 7 in the chamber, and thereafter exits the structure for detection by x-ray detector 35.

Structure 10 includes a relatively thicker substrate/spacer layer 22 and a relatively thinner window layer 24. These are spaced apart to define chamber 12, which is closed laterally by a peripheral side wall 26. Target layer 20 is applied by vapour deposition techniques, such as magnetron sputtering, thermal or electron beam evaporation, or chemical vapour deposition (CVD), to the major face 23 of substrate 22 which is the outer face relative to chamber 12.

In an alternative arrangement, the chamber 12 may be open, but, especially for use with biological sample materials studied in vivo or in vitro, is preferably sealed with a gasket or other suitable arrangement such as bonded mylar or epoxy resin.

In the present embodiment, the target layer 20 of excitable substance is an excitation layer which is typically formed of a substance of sufficiently high atomic number (Z) to provide, in response to excitation by an electron beam, medium to hard x-rays (>~1 keV) capable of readily penetrating the excitation layer and the remainder of the cell. Examples of suitable materials include gold, platinum, copper, aluminium, nickel, molybdenum and tungsten. The thickness of the target layer 20 might typically be in the range 10 nm to 1000 nm. The layer thickness is selected according to the desired effective source size which is affected, inter alia, by the desired field of view and the geometry of the exciting beam, since a take-off angle of the x-rays produced by the x-ray source excited in the excitation layer is involved.

In the case of electron excitation of target layer 20, the layer may need to be electrically connected to earth to prevent charging up if the excitation layer is a conductor. Some enhancement of cooling of the target layer via thermal conduction through the substrate may also be advantageous.

The incident particle or radiation beam, an electron beam in the preferred arrangement, is preferably of sufficient energy to excite the desired characteristic energy x-rays or range of Bremstrahlung required for imaging. In the case of excitation by an electron beam, the electron energy is desirably such as to have sufficient over-voltage relative to the characteristic x-ray energy of the principal lines proposed for use in the imaging, to yield sufficient x-ray intensity. This might be in the range 1 kV to 150 kV for the accelerating voltage of the electrons.

The substrate or spacer layer 22 may act in several ways including:

(i) as a physical support for the relatively thin target layer 20;

(ii) as a spacer layer to provide a controlled separation of the sample from the source; and (iii) as an energy bandpass filter for the transmitted radiation.

(iv) as an aid to cooling of the target layer.

Thickness here might be in the range 1 $\mu$m to 500 $\mu$m. This thickness is the prime determinant in controlling the desired magnification. A further function of this layer is to reduce the thickness over which relatively hard x-rays are produced and so this layer will typically consist of a lower atomic number and/or density material than the target layer 20. Suitable materials would include: polished Si (wafers which are commercially available), float or polished glass, and thin layers of Be, B, mica, sapphire, diamond and other semiconductor materials used as substrates. These can be produced with very smooth surfaces at close to the atomic level. When acting as a substrate, this layer should preferably be such as to provide a physical support for thin films of the excitation material (layer 20), and will preferably:

(i) be highly homogeneous, i.e. uniform in density and thickness at the atomic level; and (ii) have very smooth surfaces, in order not to significantly degrade the spatial coherence of the x-ray wavefield induced in the excitation layer, i.e. preserve high spatial coherence of the incident beam in the radiation that irradiates the sample. In this way, contrast is optimised in the image, on the basis of the concept described in international parent publication WO96/31098.

A further function of layer 22 is to truncate the splash or spreading of the electon beam in the excitation layer and thereby the effective size of the x-ray source. In certain cases layer 22 may not be required if the target material is sufficiently stable mechanically and if broadening of the effective x-ray source size is not exacerbated by the target thickness.

Figure 2:
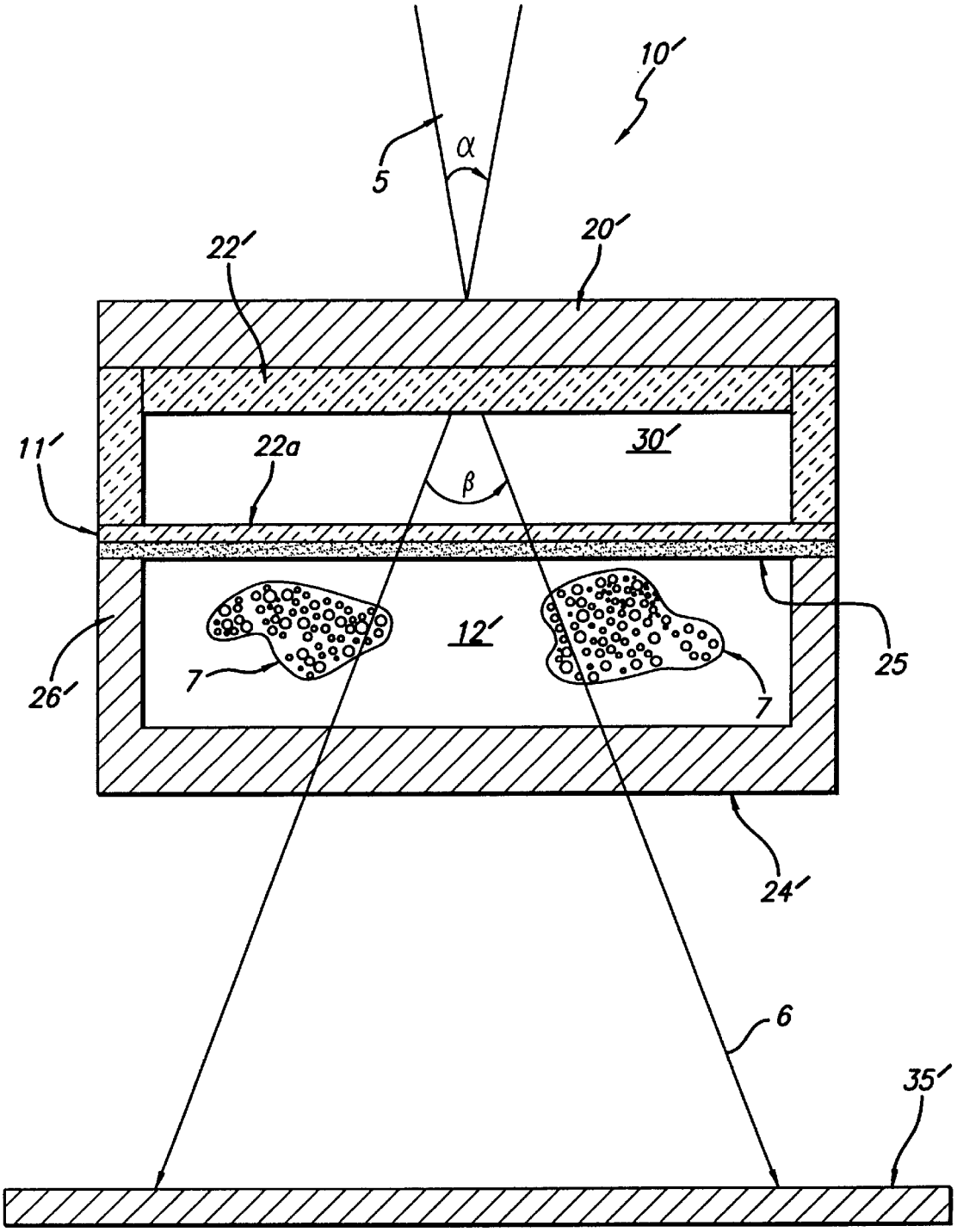
FIG. 2 is a modified sample cell appropriate to softer x-rays.

A possible modification of the basic design of the cell is to hollow out the substrate/spacer layer to reduce the effect of absorption (especially in the case of the excitation of lower energy x-rays such as Al K$\alpha$). A modified cell 10' of this general type is illustrated in FIG. 2, in which like primed numerals indicate like components. The cavity formed in layer 22' is indicated at 30. A residual thin partition 22*a* is left between cavity 30 and sample chamber 12'. This residual thin partition may be coated on the sample side with a further thin layer of material 25 in a similar manner to target layer 20' but with a view to acting as a low x-ray energy absorption filter.

Exit or window layer 24,24' may act to contain the sample and also to filter any undesired x-ray radiation coming from excitation of the substrate/spacer layer 22,22' which would have a larger effective source size than that of the excitation layer and so lead to loss of resolution. Suitable materials might include Kapton, Al, mylar, Si and Ge. Layer 24 should preferably be smooth and of uniform density so as not to lead to additional structure in the image due to phase-contrast effects. The thickness is that appropriate to achieve sufficient energy filtration or physical support for the enclosed sample. This exit window might also be coated with a suitable selective x-ray absorber.

Figure 3:
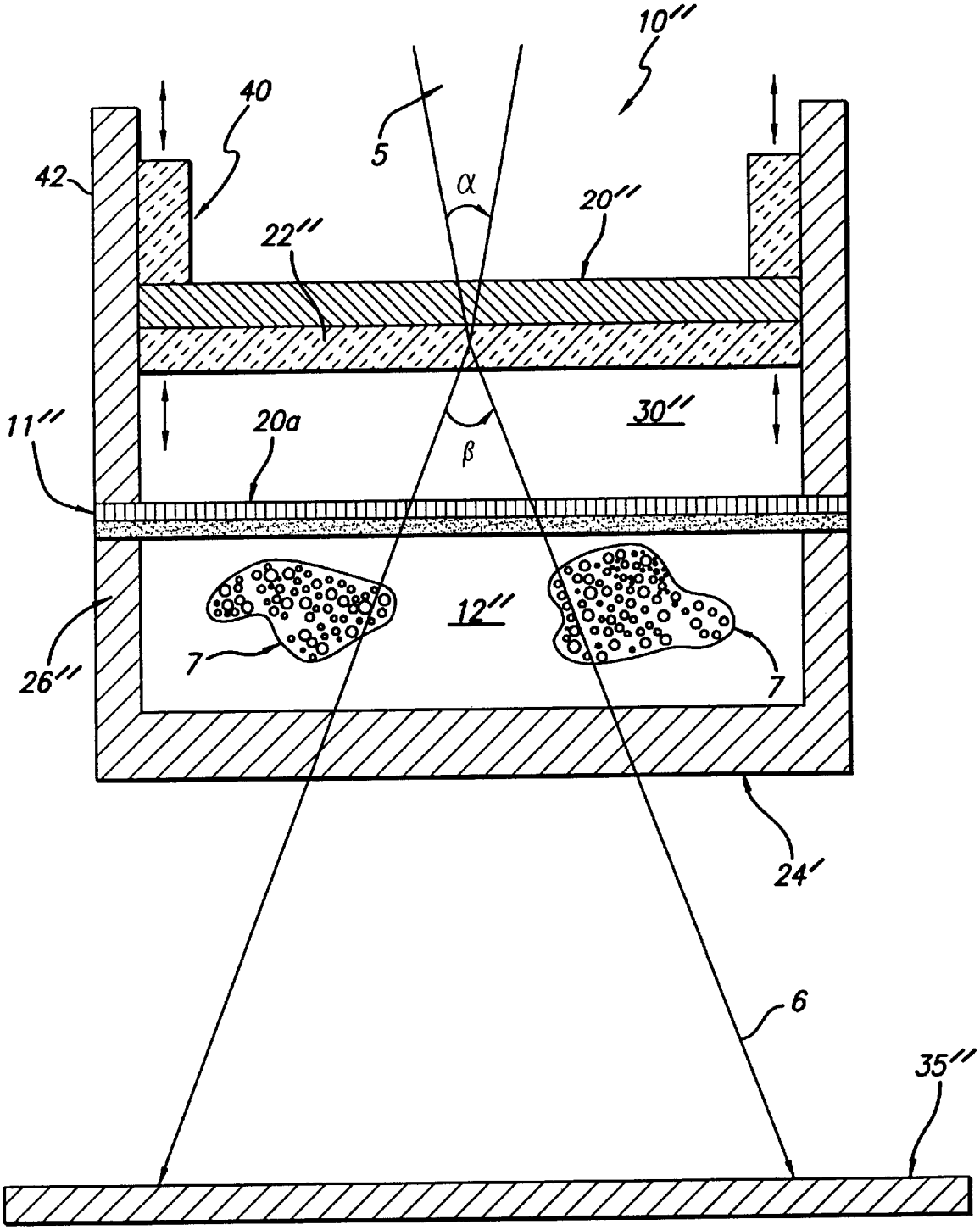
FIG. 3 is a similar view of a sample cell according to a further embodiment of the invention, enabling substantial variation of the magnification of the image from, say, ×100 to ×100,000.

A further modification of the cell is shown at 10" in FIG. 3 and enables substantial variation of the magnification in the image over a range, say, from ×100 to ×100,000. In FIG. 3, like components are indicated by like double-primed reference numerals. The variation of the magnification is achieved by providing excitable target layer 20" and substrate 22", as a unit 40 translatable towards and away from partition 22*a* within a peripheral wall 42. Alternatively, the peripheral structure 42 may be translated towards and away from the target layer 20".

Figure 4:
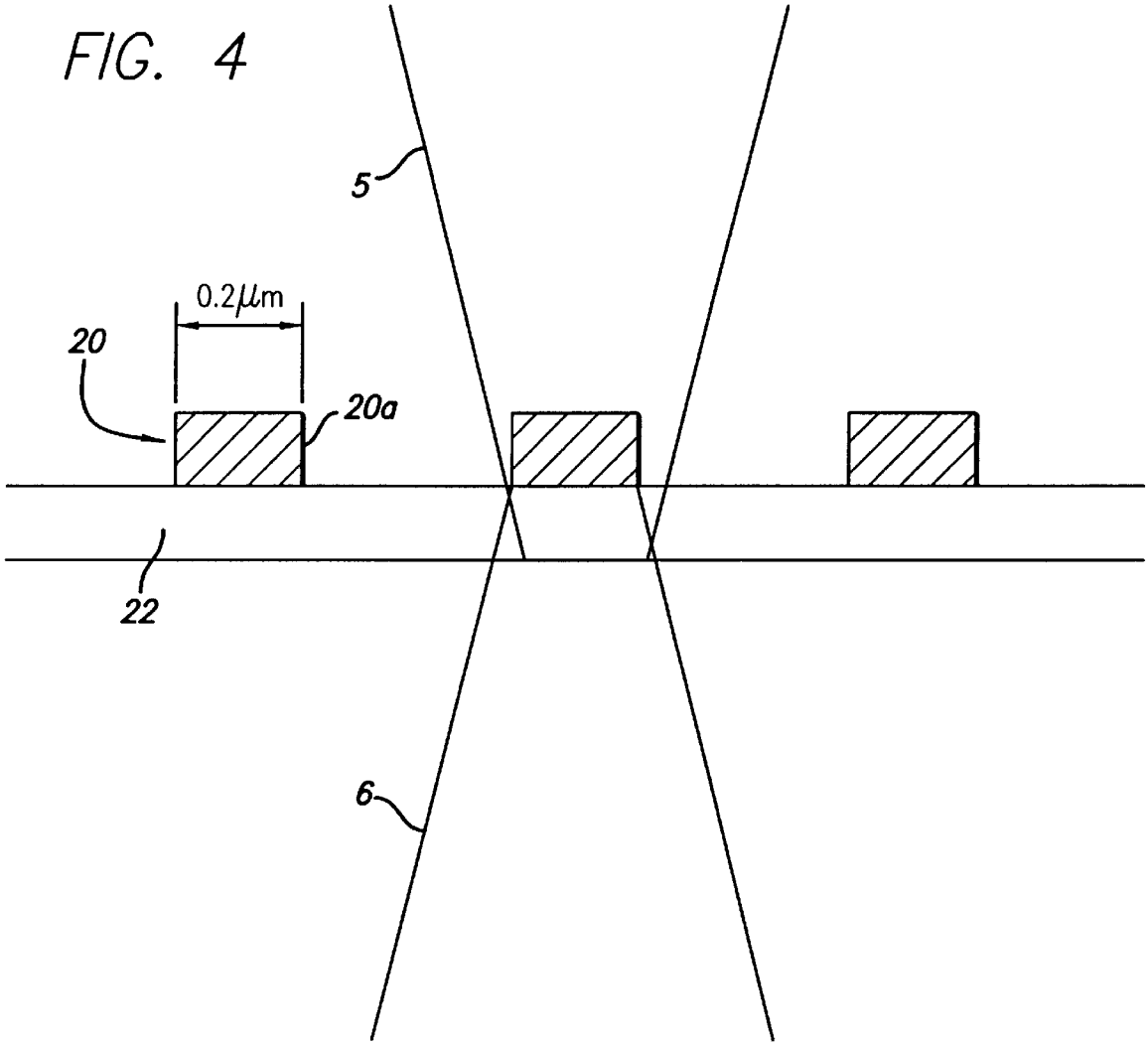
FIG. 4 is a diagrammatic representation of an embodiment in which the target layer is patterned or divided.

In another modification, target layer 20 may be divided or patterned on a continuous substrate 22. FIG. 4 diagrammatically illustrates an exemplary arrangement in which gold spots 20*a* comprising target layer 20 are spaced on a substrate 22 of silicon. The advantage of this arrangement is that an x-ray beam 6 of accurately predictable "source" size can be generated by a wider, less sharply forcussed electron beam 5.

Figure 5:
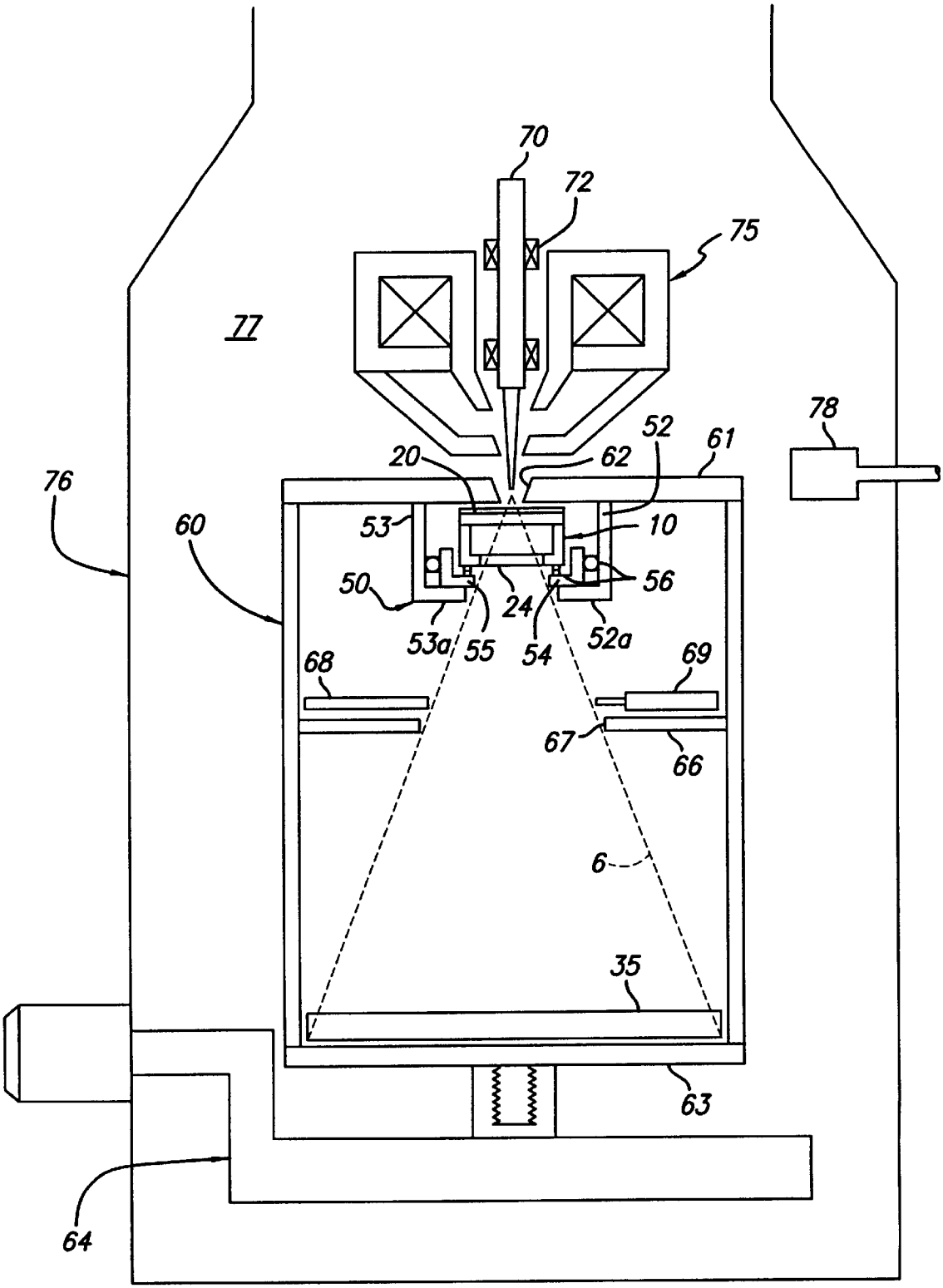
FIG. 5 is a diagram showing the sample cell of FIG. 1 mounted in the sample stage of a scanning electron microscope (SEM)

The illustrated cells would typically be manufactured by either micromachining or conventional techniques to dimensions selected so that the cell may be inserted as an integral self-contained unit, with pre-inserted sample 7 in chamber 12, into the sample stage of one or more types of commercially available electron microscopes or microprobes. FIG. 5 diagrammatically illustrates just such an assembly in a scanning electron microscope (SEM), for the embodiment of FIG. 1. Sample cell 10, once charged with a sample, is placed within a holder 50 in turn suspended from the upper wall 61 of a sample stage 60. Holder 50 includes a pair of fixed side walls 52, 53 with inturned lower flanges 52*a*, 53*a*, depending from wall 61, and adjustable rails 54, 55 that rest on flanges 52*a*, 53*a*. Respective piezo-actuators 56 provide for fine accurate adjustment of rails 54, 55 horizontally with respect to side walls 52, 53, and of cell 10 vertically with respect to rails 54, 55.

Cell 10 is centred under an irradiation aperture 62 in upper stage wall 61 through which an electron beam is directed at target layer 20 from shielded pipe 70 retained in scanning coils 72. The beam originates from a suitable electron beam source (not shown) and is surrounded by a focussing magnet 75 for focussing the electron beam onto target layer 20. For very high spatial resolution x-ray imaging, the electron beam source may advantageously be a field emission tip, in order to minimise spot size and thereby enhance lateral spatial coherence as earlier discussed.

Sample stage 60 serves as a shield against stray radiation and, as is conventional, is held on a mount 64 that allows significant vertical adjustment. The whole assembly is retained within an evacuable chamber 77 formed by an outer housing 76. A secondary electron detector 78 is provided at the side to help facilitate alignment and focussing.

Sample stage 60 further includes an annular partition 66 with a central aperture 67 controlled by a shutter 68 with driver 69. The base 63 of sample stage 60 supports an x-ray recording medium as detector 35, which in this case is in vacuum. It should be noted however that, in many cases, the detector system may be outside the vacuum chamber, in which case a suitable x-ray window means would be incorporated in the outer housing 76. Moreover, in further adaptations of the invention, the sample cell may itself constitute the vacuum window for the outer housing 76.

With the illustrated adaptation, the microscope may be used for x-ray absorption or phase-contrast imaging, and x-ray radiation 6 detected, after it passes out of window layer 24, at x-ray recording medium 35. x-ray imaging Systems utilising CCD detectors or photostimulable phosphor image plates, are suitable for use as recording medium 35. Scanners are available for processing image plates. A further advantageous embodiment of the invention involves using 2-dimensional energy resolving detectors such as those based on CdMnTe or superconducting Josephson junctions, in order to simultaneously derive one or more effective x-ray images each corresponding to a narrow x-ray energy bandpass. This is data well-suited for use in phase retrieval methods described in our co-pending international patent application PCT/AU97/00882, especially for the high spatial resolution required in the present micro-imaging context.

The configuration depicted in FIG. 4 is suitable for ultra high spatial resolution imaging of microscopic objects and features, including small biological systems such as viruses and cells, and possibly large biological molecules. The configuration makes possible a very small effective source size so that high spatial resolution or useful magnification can be obtained by making the source-to-object distance very small (down to the order of a few tens of microns or less) while the object-to-image plane distance can be macroscopic, say around 10 to 100 mm. The incident electron beam 5 is preferably focussed to a width in the range 10 to 1000 nm at the target. As earlier foreshadowed, for optimum performance in phase contrast imaging, and as taught by our co-pending international patent publication WO96/31098, all components except the sample should be such as to preserve as much as possible the high lateral spatial coherence of the x-ray beam and in practice this means that they have extremely smooth surfaces down virtually to the atomic level and also should best be of highly uniform density, ie. highly homogenous and free from micro defects and impurities.

The x-ray radiation may be substantially either polychromatic or monochromatic, according to application and method of derivation of the image. In the latter case, it may be advantageous to enhance the degree of monochromaticity, eg by judicious choice of materials and/or of the excitation voltage of the electrons striking the target layer. In the former case, it may be advantageous to invoke the use of energy sensitive detectors.

Figure 6:
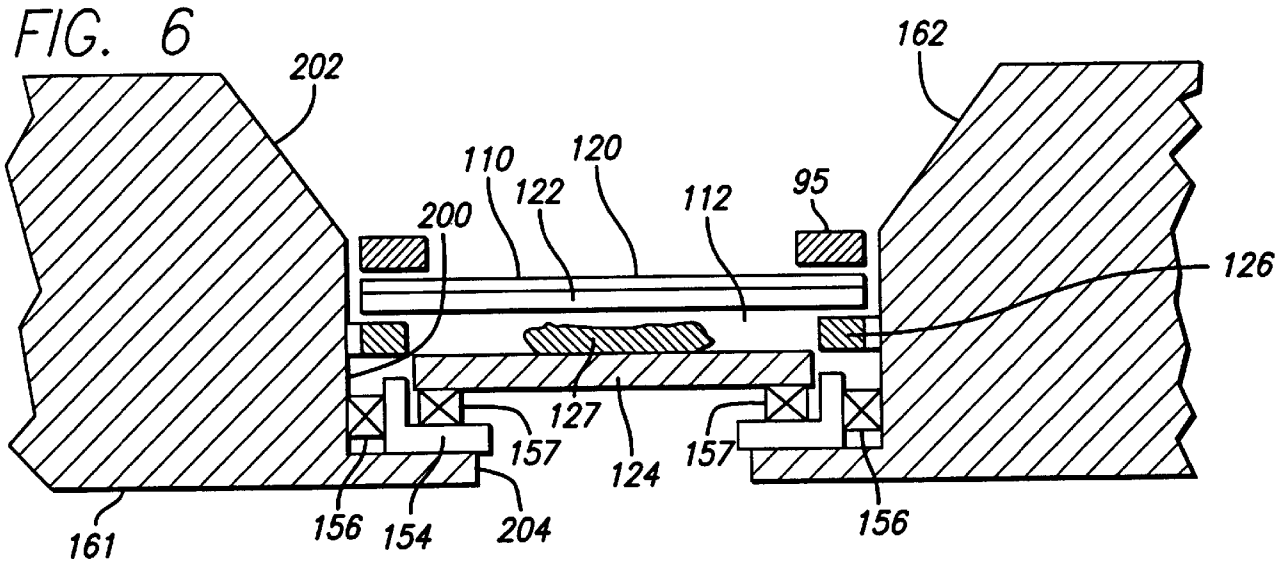
FIG. 6 is an alternative embodiment, depicted in situ, of a more loosely assembled cell.

FIG. 6 depicts an alternative embodiment in which a sample cell 110 is assembled within the irradiation aperture 162 of a sample stage upper wall 161. Aperture 162 includes a generally cylindrical cavity 200 with a divergent or conical upper opening 202 and a reduced diameter lower opening 204. Cavity 200 is divided into a lower portion and an upper portion by a fixed peripheral ring 126 akin to side wall 26 of the embodiment of FIG. 1. A window platform 124 for sample 127 is adjustably retained on lipped ring rail 154: piezo-actuators 156, 157 allow lateral and axial adjustment of sample position as before.

An integral plate comprising target layer 120 and substrate/spacer layer 122 is placed on ring 126 and, if necessary, a stabilising ring 95 placed on top to complete the assembled cell. It will be seen that sample chamber 112 is defined in part by each of substrate/spacer layer 122, ring 126 and window platform 124, and that the target layer-sample separation is adjustable in axial extent by piezo-actuators 156, 157.

Generally, of course, the target layer or sample stage may be adjustable to vary magnification in the microscope.

Figure 7:
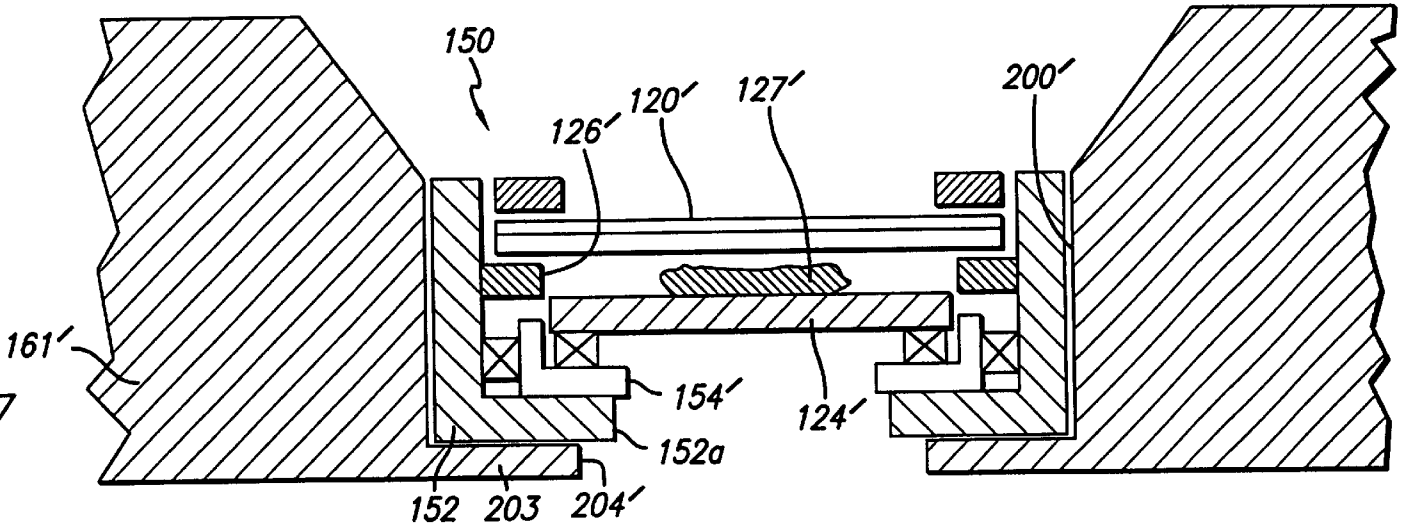
FIG. 7 is a modified form of the embodiment shown in FIG. 6.
Figure 9:
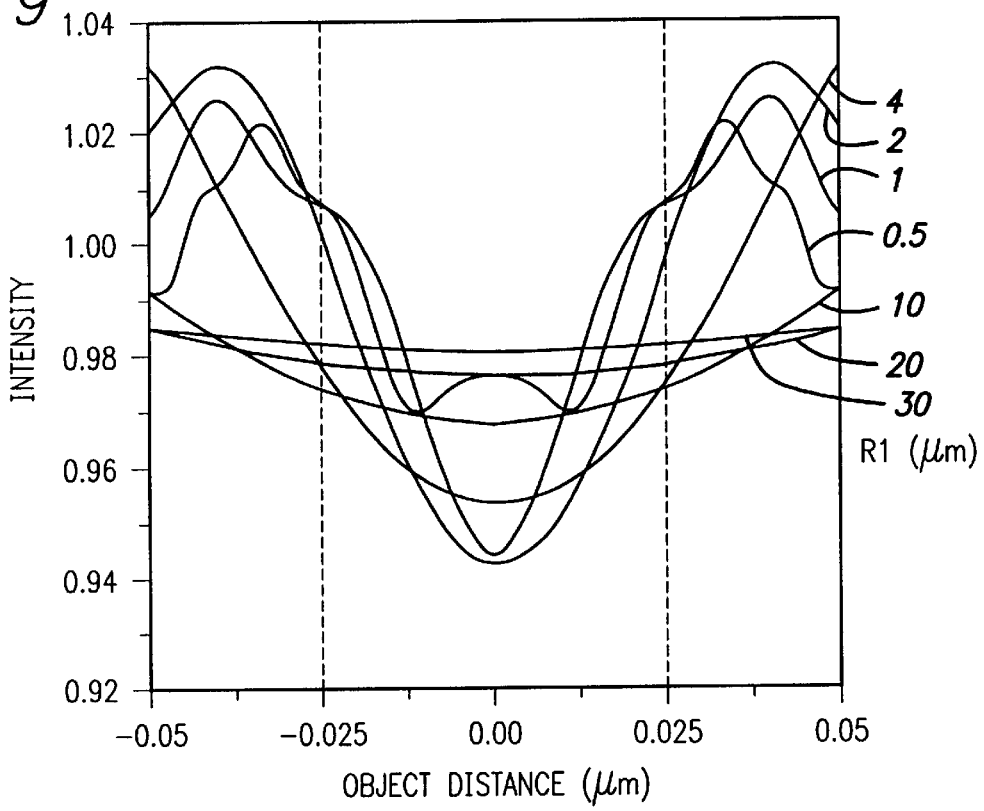
FIGS. 9 to 12 are illustrative calculated x-ray intensity profiles for a simple cylindrical sample, of different sizes and under different conditions.
Figure 10:
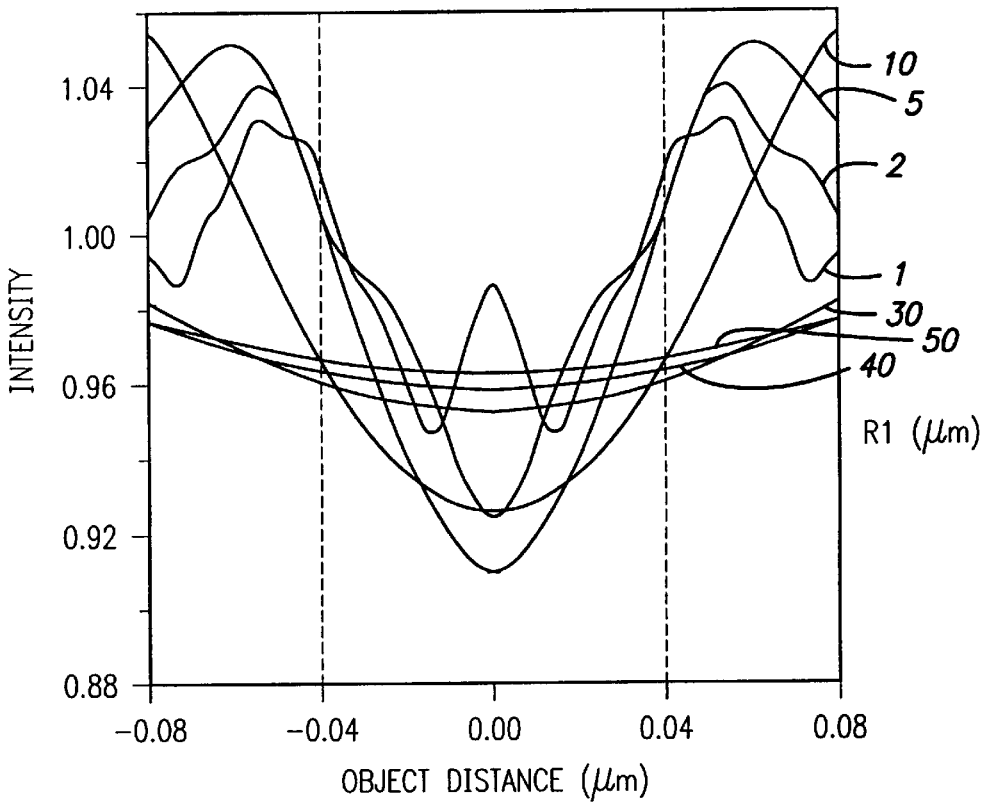
Figure 11:
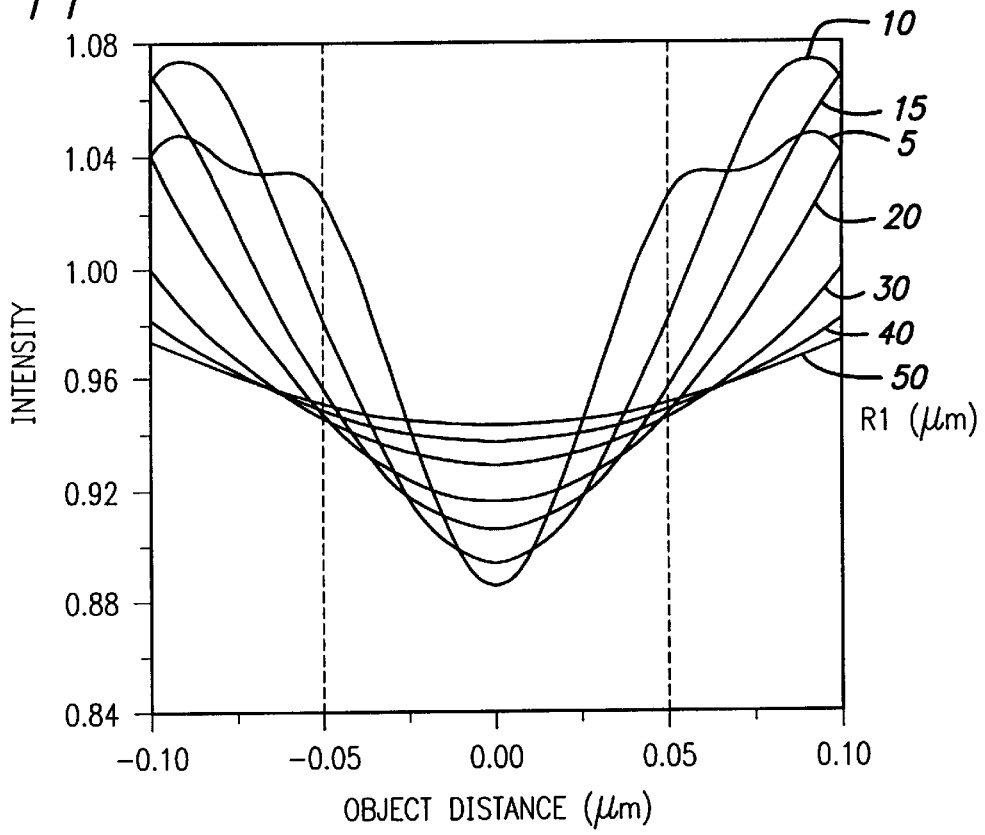
Figure 12:
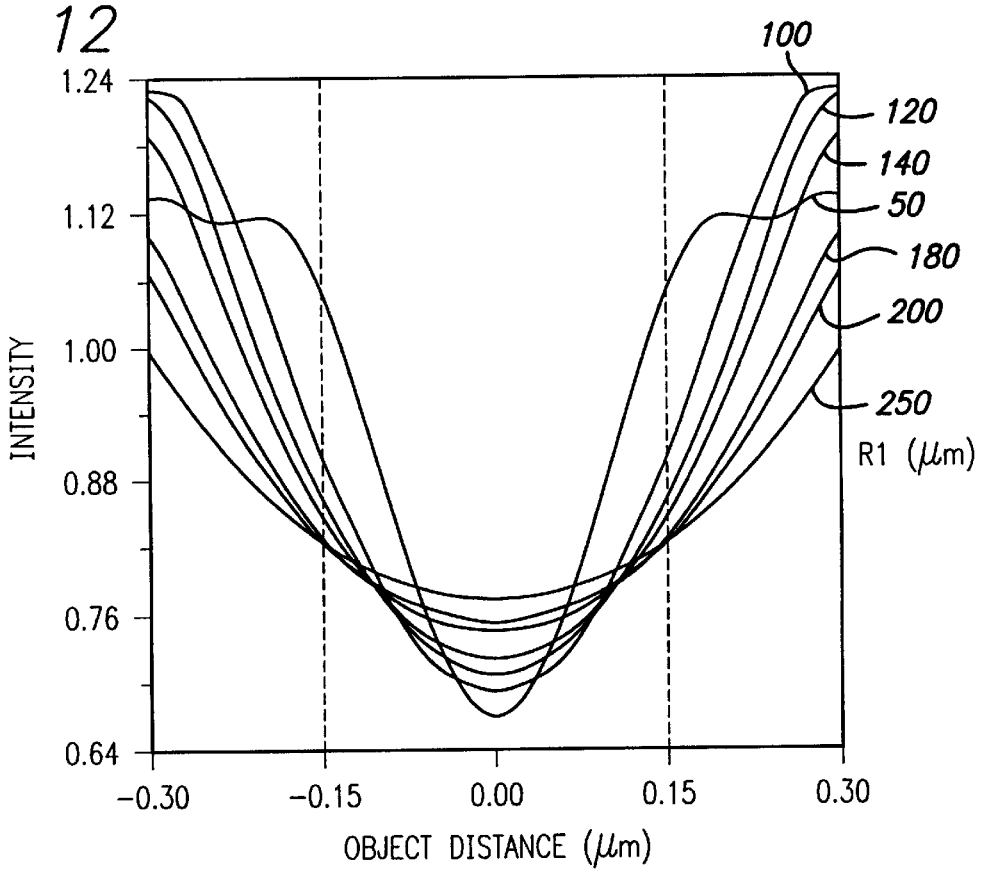

FIG. 7 is a modified form of embodiment of FIG. 6, in which like parts are indicated by like primed reference numerals. Here, the components are retained as a self-contained unit 150 defined by side wall 152, that seats snugly in cavity 200' on the rim 203 of opening 204' Dividing spacer ring 126' is fixed to this side wall, which has an inturned lower flange 152*a*, for slidably supporting lipped ring 154'.

In each of the embodiments described above, there is a single sample chamber 12. For particular applications, a self-contained cell structure may define multiple sub-cells having discrete sample chambers.

Some discussion will now be provided in relation to significant parameters in an x-ray imaging arrangement utilising a cell of the illustrated form in a scanning electron microscope. For the purpose of this discussion, the following values of the parameters indicated in FIG. 1 may be referred to: these are typical or representative values suitable for use in the practice of an embodiment of the invention.

| | | |
|---|---|---|
| $t_1$ | thickness of target layer 20 | 10 nm (and 100 nm) |
| $t_2$ | thickness of support/spacer layer 22 | 10 microns |
| $t_3$ | thickness of sample chamber 12 | a few microns (generally $t_3 \leqq t_2$) |
| $t_4$ | thickness of window layer 24 | a few tens of microns but this is not a critical parameter |
| $\alpha$ | convergence angle of incident electron beam 5 | 2° |
| $\beta$ | angular width of x-ray beam 6 | 10° |
| $1_{ni}$ | window to detector distance | 100 mm |

Blurring of the Image Due to Finite Source Size

Blurring at the image plane due to finite size of the source will occur on a spatial scale of order:

$$\sim|t_1 \sin(\beta/2)|+t_1 \tan(\alpha/2)|$$

allowing only for purely geometrical effects.

For the numbers chosen above for these parameters this would give a value of the order of 1 nm, and is therefore negligible in the case of the present parameter values.

Magnification

Figure 8:
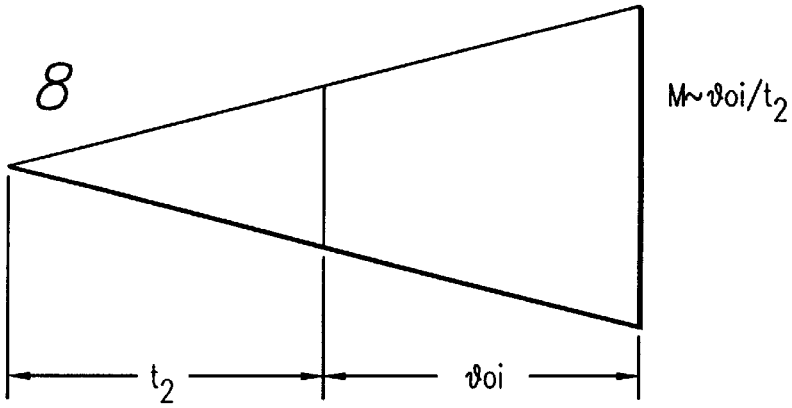
FIG. 8 is a diagram showing the principal geometrical factors affecting image magnification corresponding to FIG. 1 and referred to in the text below.

The main geometrical parameters affecting magnification, M, are indicated in the diagram of FIG. 8. With this approximation, the magnification of the image is given by:

$$M \approx (1_{oi}+t_2+t_4)/t_2 \sim 1_{oi}/t_2$$

for $1_{oi} \sim 100$ mm, $t_2 \sim 10$ $\mu$m:

$M=100/0.01=10^4$.

Therefore, a 2.5 nm feature in the object will appear as a 0.025 mm (25 $\mu$m) feature in the image. Such a feature is comparable with the typical spatial resolutions available with high-resolution digital x-ray imaging systems based on charge-coupled devices and photostimulable phosphor imaging plates.

Field of View

It is desirable that $\beta$ and $t_2$ be large in order to produce a large field of view of the sample (object), ie:

$$=2t_2 \tan(\beta/2) \approx 2t_2\beta/2$$

and for the particular parameter values chosen above $$\sim 2\times 10\times \tan(5°) \approx 2\ \mu m$$

at the object plane.

With an electronic imaging system one could record many images from the same sample by scanning (or rastering) the probe beam. A 2 micron field of view on the sample would correspond to $$(2\times10^4)\times(2\times10^4)\ (\mu m^2)=20\times20\ (mm^2)$$

on the imaging plane.

This is also well suited to the field of view of high resolution electronic imaging systems such as CCD's etc.

Contrast and Resolution

A detailed analysis of the dependence of contrast and resolution on the key physical parameters involved in x-ray imaging with a microfocus source involves the following key quantities:

| | |
|---|---|
| s | source size |
| $R_1$ | source to object plane distance |
| $R_2$ | object plane to image plane distance |
| $\lambda$ | x-ray wavelength |
| u = 1/d | where u is the spatial frequency in an object corresponding to a spatial period d |
| D | spatial resolution at the imaging plane |
| $\alpha$ | angular divergence in the quasi-plane wave case. |

The present inventors, together with others, have undertaken a classical optics treatment of contrast and resolution for partially coherent illumination of a thin object, published (after the priority date of this application) in Rev. Sci. Instrums. 68 (7) July 1997. The results may be presented in terms of optical transfer functions for both absorption—and phase-contrast contributions to the image. A summary of the critical conditions governing contrast and resolution in x-ray microscopy are presented in Table 1 appended hereto. More specifically, it may be shown that optimum phase contrast in the spherical-wave (present) case is given by:

$$u=(2\lambda R_1)^{-1/2}$$

and taking $R_1=10\ \mu m$ $\lambda=0.1$ nm one obtains u=1/d~40 nm.

The coherence limit on resolution, $d_{low}$, due to finite source size (say, s=10 nm) is $u=1/s=10^8\ m^{-1}$ or $d_{low}=10$ nm.

The visibility upper u limit, 1/s, occurs with optimum phase contrast when $R_1=s^2/2\lambda=(10\times10^{-9})^2/(2\times10^{-10})=0.5\ \mu m$ in the above case.

These results give some feeling for the dimensions of key parameters required to give optimum contrast for a given x-ray wavelength.

Analysis of image intensity data and extraction of effective pure phase and absorption-contrast images, or mixtures, may advantageously be based on Maxwell's equations or an appropriate variant, e.g. utilising the Fourier optics or appropriate Transport of Intensity Equations (TIE), as set out e.g. in our earlier patent applications in this area, especially co-pending international patent application PCT/AU97/00882.

In order to help illustrate the nature of expected contrast and resolution in the case of x-ray microscopy of very small objects using the present invention, some illustrative calculated intensity profiles (sections of images) are presented in FIGS. 9 to 12. These calculations are for a simple cylindrical sample (object)—a polystyrene fibre—of different sizes and under different imaging conditions, for 1 keV x-rays and variable $R_1$ (source-object distance) but constant $R_1+R_2$ ($R_2$ being object-image distance). The main observable features are the levels of contrast and resolution achievable with 1 keV x-rays. To a first approximation the maximum contrast condition may be gained from the results given in Table I.

The calculations from which FIGS. 9 to 12 were derived were carried out using wave optics based on the Kirchhoff formula for propagation of electromagnetic radiation. These involve fairly intensive numerical integration. Both absorption and phase effects are considered. As can be seen, the curves are of intensity in the image plane, but referred back to distance on the object. The four figures are for different diameter fibres and all are for 1 keV x-rays and $R_1+R_2$ fixed at 10 cm. Each figure shows curves for different values of $R_1$ (and therefore $R_2$). The vertical dashed lines mark the edges of the associated fibre. Even for the smallest fibre (0.05 $\mu$m) there is around 4% contrast for suitable $R_1$, which is useful. An intensity value of unity corresponds to what would be obtained in the absence of an object.

Object Reconstruction in the X-ray Microscope

The projected structure of a sample (object) can be reconstructed from one or more digitised images in several ways, depending on the nature of the object, and the accuracy and degree of sophistication desired. Reconstruction in this context means determining the distribution of both real (refractive) and imaginary (absorptive) parts of the projected refractive index of the object along the optic axis.

In many cases, especially for thin objects typically examined in a microscope, the most useful starting point is perhaps the linearized diffraction equation (in 1 dimension):

$$I(u)/I_o\cong\delta(u)-2\sin(\pi\lambda zu^2)\phi(u)-2\cos(\pi\lambda zu^2)\mu(u) \quad (1)$$

where $\lambda$ is the x-ray wavelength, $z=R_1R_2/(R_1+R_2)$ and for microscopy $z\approx R_1$, and I, $\phi$ and $\mu$ are the Fourier representations of the image intensity and object phase and absorption transmission functions respectively. The variable u represents spatial frequency. An incident monochromatic plane wave propagating in the z direction is assumed. The present discussion is in terms of the plane wave case, although the spherical-wave case is really more appropriate for microscopy and can be deduced from the plane wave case by suitable algebraic transformations.

In general $\phi(u)$ and $\mu(u)$ cannot both be determined from a single measurement of I(u); at least two independent measurements, using different values of z or $\lambda$ are needed. However, for the case of a pure phase object, for which the last term in equation (1) vanishes, a single measurement of I(u), i.e. measuring a single image, is in principle sufficient to determine $\phi(u)$, the spatial distribution of phase shift due to the object. Even here, however, there are advantages in performing several measurements, to reduce the effects of noise and of the zeroes of the "transfer function" $\sin(\pi\lambda zu^2)$, which cause loss of information for specific values of the spatial frequency u. This is one reason why the variability of "focal length" z and/or wavelength $\lambda$ is considered to be a useful feature of the present instrument.

For sufficiently small values of $\lambda zu^2$ a further simplification may be made to equation (1), viz the sin and cos terms may be expanded to first order, giving:

$$I(u)-I_o(u)\approx-2\pi\lambda zu^2\phi(u) \quad (2)$$

which is similar to a form of the Transport of Intensity Equation (M. R. Teague J.Opt.Soc.Am., A73, 1434–41, (1983); T. E. Gureyev, A. Roberts, & K. A. Nugent, J.Opt.Soc.Am., A12 1932–41, 1942–46 (1995); Gureyev & Wilkins, J.Opt.Soc.Am. A15, 579–585 (1998). It describes the differential phase-contrast regime (Pogany, Gao, &

Wilkins, Rev. Sci. Instrum. 68,2774–82 (1997) which has already been demonstrated (see Wilkins et al, Nature (1996)).

If the linear theory is inadequate, one may revert to the basic Fresnel-Kirchoff diffraction formula (in Fourier space):

$$F(u)=\exp(-ikz)Q(u)\exp(i\pi\lambda zu^2) \quad (3)$$

and attempt to find the object transmission function Q which best reproduces the observed intensity(ies) $I(x)=|F(x)|^2$. This may be carried out iteratively, in a similar manner to that used in numerical forms of reconstruction (retrieval) of optical holograms and electron microscope images, and several schemes have been described (J. R. Fienup, "Phase Retrieval Algorithms: A Comparison", Appl. Opt 21 2758 (1982); R. W. Gerchberg and W. O. Saxton, Optik (Stuttgart) 35 237, (1972)). Convergence, however, is often very slow, and there is much scope for improved algorithms.

The above all refer to one- or two-dimensional projections of object structure. For three-dimensional object reconstruction at least two projections are generally required (stereoscopy) or many (for tomography). The former might be achieved in the present instrument by use of beam deflection; the latter would require a means of accurately rotating the specimen, which could be done by conventional mechanical means but would require further modifications beyond the standard microscope configuration described in this application.

Advantages of the illustrated sample cells and related method for high resolution hard x-ray imaging (especially phase-contrast imaging) include the following:

Very high spatial resolution (ie. useful magnification).

Can be used in conjunction with high resolution scanning electron microscopes as a special sample cell.

Can be used to study biological samples in vivo or in vitro in an electron microscope without requiring the biological sample itself to be in vacuo, although the sample cell is in vacuo (but appropriately sealed with a gasket or epoxy, say)

Reduced radiation damage to the sample as result of the ability to obtain image contrast at higher x-ray energies than conventional soft x-ray microscopy of biological material.

Can vary the characteristic x-ray energy by using different excitation target materials and/or electron accelerating voltage.

High mechanical stability due to integrated structure

Exit window of cell can be used to act as a rejection filter of low energy x-rays and so remove (clean up) unwanted background radiation (especially from the substrate/spacer layer) which might degrade overall resolution due to having a large effective source size.

The volume of the cell may be made quite small. This might even be made adjustable in situ by use of an appropriate gasket and applied pressure, with possibility of adjustment to improve the visibility of certain features of interest in the sample.

Cells are in principle reusable.

Cells could be maintained at, say, room temperature by appropriate heating stage in microscope.

Can study large area of sample by shifting e-beam or translating sample cell, and recording different exposures.

Focusing of the electron beam on the excitation target can be conveniently monitored by use of the secondary electron detector, or by the use of electronic imaging detectors.

Can be used to implement limited field computerised tomography (CT) either by scanning the exciting beam on the target or by rotating the whole cell.

TABLE 1

Summary of the characteristics of in-line imaging without lenses
[After Pogany et al, Rev. Sci. Instrums. July, 1997]

| | | |
|---|---|---|
| A. General | | |
| Advantages: | Simplicity of apparatus, i.e. no lenses or mirrors, no aberrations. Modest requirements for monochromaticity. Similar to present radiography systems. Reduced incoherent scattering contribution. Both amplitude and phase information can be derived from intensity data. | |
| Disadvantages: | Source of high lateral coherence required. May require appropriate image-reconstruction procedure. Useful physical magnification limited by source size and closeness of approach of sample to source. No physical access to focal plane, which would allow employment of various contrast mechanisms. Increased sensitivity to the quality of in-beam components such as windows and filters. | |
| Quantity of Interest | Plane-Wave $R_1 > R_2$ | Spherical-Wave $R_2 > R_1$ |
| B. Phase Contrast | | |
| Optimum contrast: u = | $(2\lambda R_2)^{-1/2}$ | $(2\lambda R_1)^{-1/2}$ |
| Coherence resolution limit: u = | $1/\alpha R_2$ | $1/s$ |
| Visibility, upper u limit: | None | $1/s$ with optimum contrast at $R_1 = s^2/2\lambda$ |
| Visibility, lower u limit: (This limit is considerably reduced when allowance is made for differential phase contrast.) | $\alpha/2\lambda$ (= coherence width$^{-1}$), with optimum contrast at $R_1 = 2\lambda/\alpha^2$ | None (coherence width = $\lambda R_1/s$) |
| Limitations to high resolution: | collimation, detector resolution, object-detector proximity, energy spread | Source size, source-object proximity, energy spread |
| C. Absorption contrast | | |
| Visibility, upper u limit: | None; provided $R_2 < 1/u\alpha$ | $1/s$ arbitrary $R_1$ |
| Visibility, lower u limit: | None | None |
| Limitations to high resolution: | Detector resolution, object-detector proximity, energy spread | Source size, energy spread |

What is claimed is:

1. A sample cell for use in x-ray imaging, including structure defining a chamber for a sample, and mounted to said structure, a body of a substance excitable by an appropriate incident beam to generate x-ray radiation, the cell being arranged so that, in use, at least a portion of the x-ray radiation traverses said chamber to irradiate the sample therein and thereafter exits the structure for detection.

2. A sample cell according to claim 1 wherein said cell is an integral self-contained unit adapted and dimensioned to be inserted in complementary holder means of an electron microscope or microprobe at a position where the electron beam of the microscope is focused on said body of excitable substance, and thereby provides said incident beam for exciting said substance to generate x-ray radiation.

3. A sample cell according to claim 1 wherein said substance is excitable by an incident focused beam of electromagnetic radiation to generate x-ray radiation.

4. A sample cell according to claim 1, wherein said cell is an array of layers, of dimensions parallel to the plane of the layers in the range of about 1 micron to 10 millimeters.

5. A sample cell according to claim 4 adapted for use in phase contrast imaging, wherein said layers through which the excited x-ray radiation passes are highly homogeneous and have very smooth surfaces for preserving high spatial coherence of the incident beam in the radiation that irradiates the sample, and thereby optimizing useful contrast in the image.

6. A sample cell according to claim 1 wherein said body of excitable substance is a layer of the substance applied to the structure defining the cell.

7. A sample cell according to claim 6 wherein said layer of excitable substance is of a thickness in the range 10 to 1000 nm, and arranged so that, in use, the separation of this layer from the sample is in the range of 1 to 1000 $\mu$m.

8. A sample cell according to claim 6 wherein said structure includes a substrate and/or spacer layer, transparent generally to x-rays or to a selected x-ray energy band(s), separating the layer of excitable substance from the sample.

9. A sample cell according to claim 8 wherein said substrate and/or spacer layer is strongly absorbing for energies outside said selected x-ray energy band(s) in order to enhance the chromatic coherence of the x-ray beam contributing to the image.

10. A sample cell according to claim 1 wherein said body is a divided or patterned array of body portions retained on a common substrate.

11. A sample cell according to claim 10 wherein said divided or patterned array of body portions comprises an array of spots spaced on a common substrate.

12. A sample cell according to claim 11 wherein said spots are of diameter about 0.2 micron.

13. A sample cell according to claim 12 wherein said spots are arranged whereby said incident beam is wider than each spot.

14. A sample cell according to claim 11 wherein said spots are arranged whereby said incident beam is wider than each spot.

15. A sample cell according to claim 1 wherein said chamber is open.

16. A sample cell according to claim 15 wherein said chamber is arranged to be hermetically sealed after placement of a sample in the chamber.

17. A sample cell according to claim 1 wherein said chamber is adapted to be enclosed, and said structure includes an x-ray transparent window by which the said x-ray radiation exits the structure for detection.

18. A sample cell according to claim 1 in combination with an energy detector.

19. A kit of components adapted to form a sample cell according to claim 1 wherein in situ in holder means of an electron microscope or microprobe at a position where said electron beam is focused on said body of excitable substance, and thereby provides said incident beam for exciting said substance to generate x-ray radiation.

20. A method of deriving a magnified x-ray image of one or more internal boundaries or other features of a sample, comprising:

disposing the sample in a sample cell including a body of an excitable substance and a chamber for holding the sample;

fitting the cell into holder means of an electron microscope or microprobe at a position where an electron beam generated by the microscope or microprobe is focused on said body of excitable substance;

irradiating said excitable substance with said electron beam to cause the substance to generate x-ray radiation, at least a portion of which traverses the chamber to irradiate the sample, including the one or more internal boundaries or other features, and thereafter exits the cell structure; and detecting and recording at least a portion of said radiation exiting the cell structure after it has irradiated the sample, to provide an image of the one or more internal boundaries or other features of the sample.

21. A method according to claim 20 wherein said x-ray imaging is phase-contrast imaging or a mixture of absorption-contrast and phase-contrast.

22. A method according to claim 21 wherein said incident x-ray beam and said radiation that irradiates said sample are highly spatially coherent, for optimizing useful contrast in the image.

23. A method according to claim 20 wherein said electron beam is focused to a width in the range 10 to 1000 nm in said body of excitable substance.

24. A method according to claim 20 wherein the sample cell utilized is an array of layers, of dimensions parallel to the plane of the layers in the range of about 1 micron to about 10 millimeters, and wherein said layers through which the excited x-ray radiation passes are highly homogeneous and have very smooth surfaces for preserving high spatial coherence of the incident beam in the radiation that irradiates the sample, thereby optimizing useful contrast in the image.

25. A method according to claim 20 wherein the x-ray radiation generated by the excitable substance is in the medium to hard x-ray range, i.e. in the range 1 keV to 1 MeV, and is substantially polychromatic.

26. A method according to claim 20 wherein the x-ray radiation generated by the excitable substance is substantially monochromatic, and the method further includes enhancing the degree of monochromaticity of this x-ray radiation.

27. A method according to claim 20 wherein said body is an array of spots spaced on a common substrate, and wherein said electron beam is wider than each spot.

28. An x-ray microscope or microprobe having means to generate a focused electron beam, a sample cell adapted to be retained in holder means at a position where said electron beam is focused on said body of excitable substance, and thereby provides said incident beam for exciting said substance to generate x-ray radiation, and a detector located externally of the sample cell, said x-ray radiation traversing a portion of the sample cell to irradiate a sample, whereby at least a portion of the x-rays irradiating the sample exits the sample cell and is detected.

29. An x-ray microscope or microprobe according to claim 28 wherein the electron beam is focused to a width in the range 10 to 1000 nm in said body of excitable substance.

30. An x-ray microscope or microprobe according to claim 28 wherein said means to generate a focused electron beam includes a field emission tip electron source.

31. An x-ray microscope or microprobe according to claim 28 further including an energy detector.

32. An x-ray microscopic imaging configuration comprising:

a sample cell including means to support a sample and a body of a substance excitable by an appropriate incident beam to generate x-ray radiation, said body being retained on a substrate disposed in use between said body and said sample and thereby serving as a spacer;

a detection device located external to the sample cell for detecting x-ray radiation that has traversed the sample cell; and means to adjust the relative position of said sample and said body.

33. An x-ray microscopic imaging configuration according to claim 32 wherein said substrate is also a filter of said x-ray radiation.

34. An x-ray microscopic imaging configuration according to claim 32 wherein said substance is excitable by an incident electron beam.

35. An x-ray microscopic imaging configuration according to claim 32 wherein said substance is excitable by an incident focused beam of electromagnetic radiation to generate x-ray radiation.

36. An x-ray microscopic imaging configuration according to claim 32 adapted for use in phase contrast imaging, wherein said body and said substrate are layers that are highly homogeneous and have very smooth surfaces after and including the exit boundary of said body for preserving high spatial coherence of the incident beam in the radiation that irradiates the sample, and thereby optimizing useful contrast in the image.

37. An x-ray imaging configuration according to claim 32 wherein said body is a divided or patterned array of body portions retained on a common substrate.

38. An x-ray imaging configuration according to claim 37 wherein said divided or patterned array of body portions comprises an array of spots spaced on a common substrate.

39. An x-ray imaging configuration according to claim 38 wherein said spots are of diameter about 0.2 micron.

40. An x-ray imaging configuration according to claim 39 wherein said spots are arranged whereby said incident beam is wider than each spot.

41. An x-ray imaging configuration according to claim 38 wherein said spots are arranged whereby said incident beam is wider than each spot.

* * * * *

UNITED STATES PATENT AND TRADEMARK OFFICE

CERTIFICATE OF CORRECTION

PATENT NO. : 6,163,590

DATED : Dec. 19, 2000

INVENTOR(S) : Stephen William Wilkins

It is certified that error appears in the above-identified patent and that said Letters Patent is hereby corrected as shown below:

Column 4, line 29, change "10", to read --11--.

Column 8, line 33, in the equation, after "+" but before "$t_1$", add equation summation symbol --|--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*